United States Patent [19]

Pech et al.

[11] 4,301,746

[45] Nov. 24, 1981

[54] DEASHER

[75] Inventors: Hans-Jürgen Pech, Dorsten; Herbert Schäfer, Gladbeck, both of Fed. Rep. of Germany

[73] Assignee: Deutsche Babcock Aktiengesellschaft, Oberhausen, Fed. Rep. of Germany

[21] Appl. No.: 161,654

[22] Filed: Jun. 20, 1980

[30] Foreign Application Priority Data

Jul. 13, 1979 [DE] Fed. Rep. of Germany ..... 2928345

[51] Int. Cl.[3] ..... F23J 1/02

[52] U.S. Cl. ..... 110/165 R; 110/171

[58] Field of Search ..... 110/165 R, 171; 198/616, 716, 728

[56] References Cited

U.S. PATENT DOCUMENTS 4,112,856 9/1978 Fuhrman et al. ..... 110/165 R 4,227,468 10/1980 Bachmüller et al. ..... 110/171 X

*Primary Examiner*—Edward G. Favors

*Attorney, Agent, or Firm*—Max Fogiel

[57] ABSTRACT

A deasher arrangement in which a water-filled trough is arranged beneath the ash hopper of a boiler. The trough is laterally movable, and accommodates a conveying device. A lifting device is provided with a lift corresponding at least to the boiler expansion. The trough is associated, furthermore, with a dipping element connected to the ash hopper and permanently extending into the water fill of the trough during operation of the boiler. The trough consists of two sections separated by a partition wall, and accommodates one conveying equipment each. The partition wall has a height which is lower than the side walls of the trough. The top of the partition wall is situated above the bottom of the dipping element when the boiler is in operation and the trough is raised. An additional partition wall may be provided with a collecting tray therebetween.

2 Claims, 3 Drawing Figures

DEASHER

BACKGROUND OF THE INVENTION

The present invention relates to a deasher (ash extractor) consisting of a trough which, arranged underneath the ash hopper of a boiler, is filled with water, is laterally movable, is provided with conveying equipment, and is equipped with lifting means. The lift of the latter corresponds at least to the boiler expansion, and is associated with a dipping element which is connected with the ash hopper and permanently extends into the water fill of the trough during operation of the boiler.

Such a deasher is known from DE-AS 12 86 255 (German application placed open to public inspection after examination). The lifting means allows the trough of this prior art deasher to be lowered so much, that it may be moved laterally under the hopper and may be replaced by a new one.

For the purpose of moving deashers which are not provided with lifting means, one side wall of the trough is provided with a sealed flap which is as wide as the dipping element connected with the ash hopper. When the deasher must be changed during operation, a twin trough consisting of two sections may be provided for. The two sections are separated by a collapsible partition wall. Such a partition wall can no longer be sealed sufficiently when the ash hopper has large slot widths.

SUMMARY OF THE INVENTION

The invention pursues the object of creating a wet deasher which is suitable for ash hoppers with a large slot width and may be exchanged during operation of the boiler.

Another object of the present invention is to provide a deasher which is substantially simple in construction and may be economically fabricated.

A further object of the present invention is to provide an arrangement of the foregoing character which may be readily maintained in service and which has a substantially long operating life.

These objects are achieved by the following: the trough consists of two sections which are separated by a partition wall and which accommodate one conveying equipment each; the partition wall is lower than the side walls of the trough, and the top of the partition wall is situated above the bottom of the dipping element when the boiler is in operation and the trough is lifted.

Sealing the partition wall is not necessary on this wet deasher. When the boiler is warm, the dipping element of the ash hopper extends into one of the sections. When it is intended to move the wet deasher, the water level in the trough will be raised and the trough will be lowered by the lifting means. In this case the top of the partition wall will be situated below the bottom of the dipping element extending into the raised water level. As a result, the trough may be moved laterally without being hindered by the dipping element.

The novel features which are considered as characteristic for the invention are set forth in particular in the appended claims. The invention itself, however, both as to its construction and its method of operation, togehter with additional objects and advantages thereof, will be best understood from the following description of specific embodiments when read in connection with the accompanying drawings.

DESCRIPTION OF THE PREFERRED EMBODIMENTS

Figure 1:
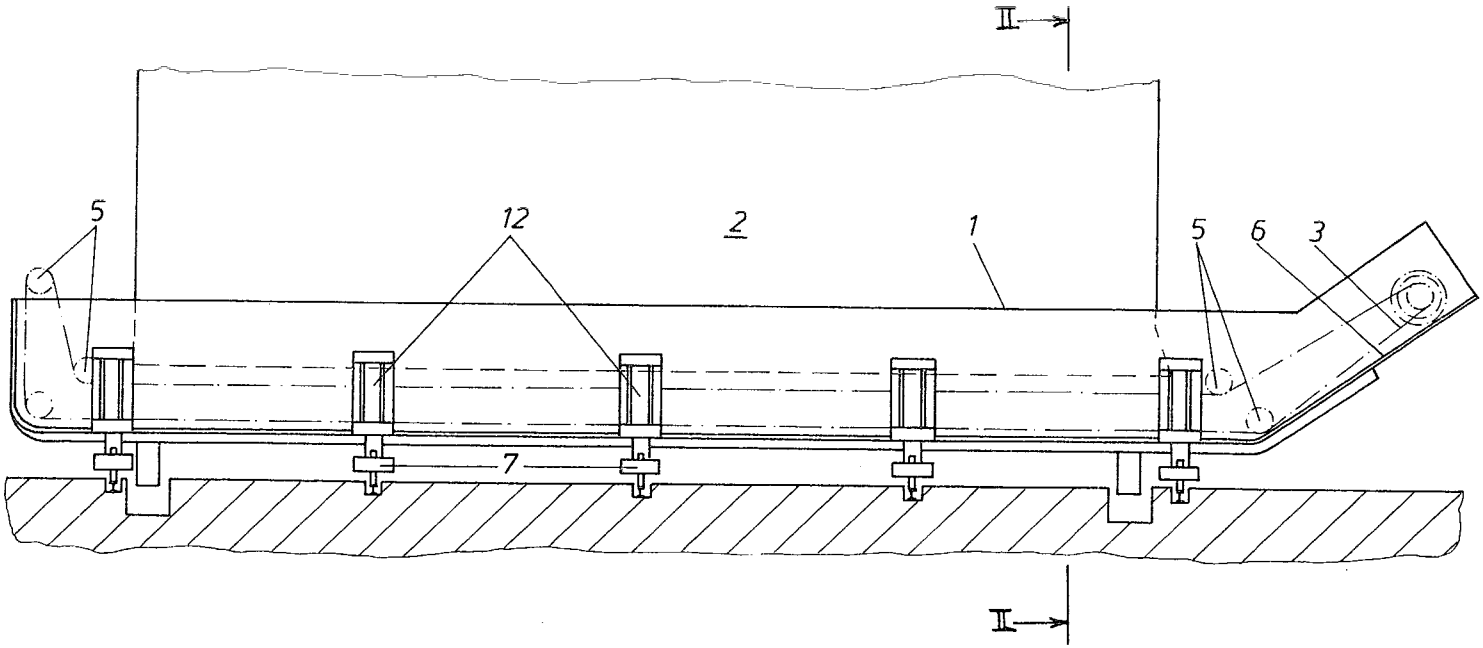
FIG. 1 is the side view of a deasher, in accordance with the present invention.
Figure 2:
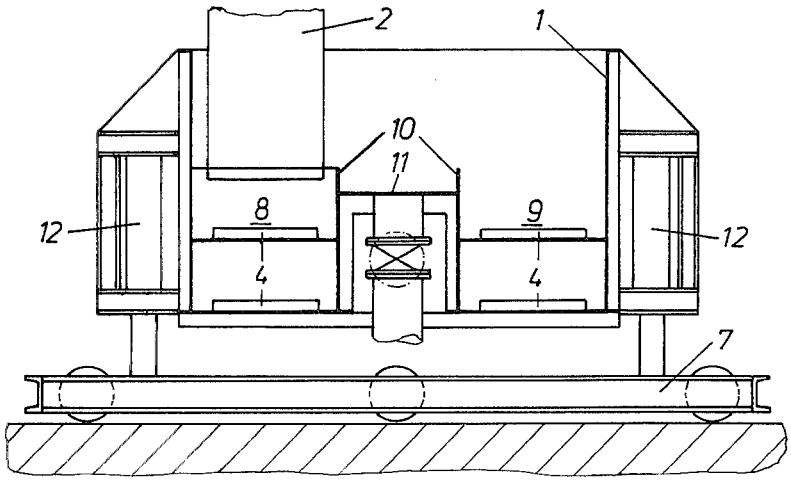
FIG. 2 is a section taken along II—II according to FIG. 1, for a deasher in the operating condition.
Figure 3:
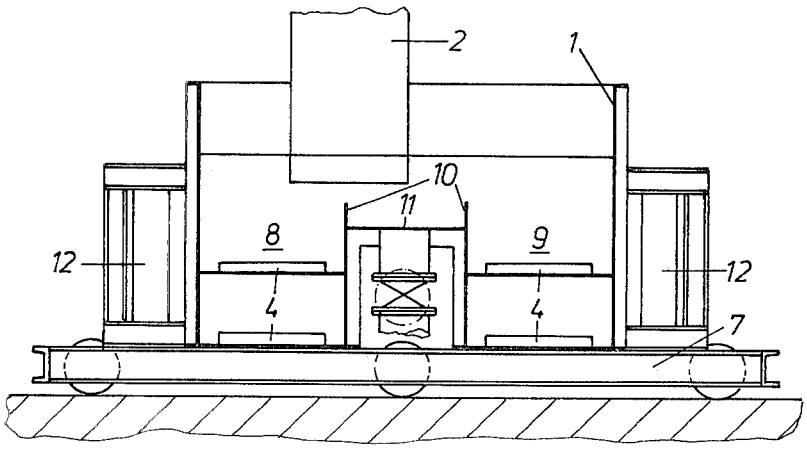
FIG. 3 is a section taken along II—II according to FIG. 1, for a deasher being moved.

The wet deasher consists of a water-filled trough 1 which is arranged underneath the ash hopper of a pulverized coal-fired boiler. A dipping element 2 connected with the ash hopper permanently extends into the water level of the trough during operation of the boiler. Thus the ash hopper is movably sealed from the trough 1.

The trough 1 is open at top and rises towards one side. Conveying equipment designed as a drag-chain conveyor runs in trough 1 and discharges the ash dropping from the ash hopper, and is cooled in the water. The drag-chain conveyor consists of two chains 3 between with flights 4 are attached at a distance from each other. The chains 3 are guided by rollers 5. The ash falling into the trough 1 is taken to the ash exit 6 by the flights 4 in the upper strand of the drag-chain conveyor and is discharged there.

The trough 1 is supported on the undercarriage 7 which serves for moving the trough 1 laterally.

The trough 1 is designed as a twin trough and is provided with two sections 8 and 9 accommodating one drag-chain conveyor each. Each section 8 and 9 is provided with its own water supply and water discharge. The two sections 8 and 9 of the trough 1 are separated by two partition walls 10. Between the two partition walls 10 there is a collecting tray 11 with an own water discharge. Each partition wall 10 is lower than the side walls of the trough 1.

The collecting tray 11 collects water to be discharged from both sections 8 and 9, and discharges the water through its own common water discharge.

Only section 8 or 9 is filled with water during operation of the boiler. The dipping element 2 extends into the water level of this section. The other section is avialable as standby.

The trough 1 is provided with lifting means 12 which, in the present case, is hydraulic. This lifting means 12 engages the longitudinal side walls of the trough 1 and is supported on the undercarriage 7. The lift of the lifting means 12 corresponds at least to the boiler expansion. During boiler operation, the trough 1 is raised by the lifting means 12. Spacers support the trough 1 during operation for relieving the lifting means 12. The maximum boiler expansion, the lift of the lifting means 12, and the height of the partition wall 10, are harmonized between each other so that the top of the partition wall 10 is situated above the bottom of the dipping element 2, when the boiler is in operation and the trough 1 is raised.

During the boiler starting phase, the trough 1 is filled with water beyond the sections 8 and 9. The dipping element 2 extends into this raised water level. When the boiler is becoming increasingly warmer and the boiler body is expanding to an ever increasing extent, the dipping element 2 extends into the section 8. The water level above it will be discharged.

When it is intended to take the drag-chain conveyor within section 8 out of operation for the purpose of repair, the water level in trough 1 will be raised. At the same time trough 1 will be lowered by the lifting means 12 after removal of the support spacers. Now the bottom of the dipping element 2 is situated above the partition wall 10, but still dips into the water level. In this position, the trough 1 may be moved laterally until the dipping element 2 is located above the other section 9. When trough 1 has reached this position, it will be raised and the water will be discharged from section 8.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A deasher arrangement comprising: ash hopper means of a boiler; a water-filled trough arranged underneath said ash hopper means; said water-filled trough being laterally movable and having conveying means; said trough having lifting means with lift corresponding at least to expansion of the boiler; a dipping element connected to said ash hopper means and permanently extending into the water fill of the said trough during operation of the boiler; said trough comprising two sections separated by a partition wall and having one conveying means each; said partition wall having a height which is lower than side walls of said trough; said partition wall having a top which is situated above the bottom of the dipping element when the boiler is in operation and the trough is raised.

2. A deasher as defined in claim 1 including an auxiliary partition wall spaced from said first-mentioned partition wall; and collecting tray means between said two partition walls.

* * * * *